US008886529B2

(12) United States Patent
Faure et al.

(10) Patent No.: US 8,886,529 B2
(45) Date of Patent: Nov. 11, 2014

(54) METHOD AND DEVICE FOR THE OBJECTIVE EVALUATION OF THE VOICE QUALITY OF A SPEECH SIGNAL TAKING INTO ACCOUNT THE CLASSIFICATION OF THE BACKGROUND NOISE CONTAINED IN THE SIGNAL

(75) Inventors: Julien Faure, Ploubezre (FR); Adrien Leman, Hellemmes-Lille (FR)

(73) Assignee: France Telecom, Paris (FR)

( * ) Notice: Subject to any disclaimer, the term of this patent is extended or adjusted under 35 U.S.C. 154(b) by 420 days.

(21) Appl. No.: 13/264,945

(22) PCT Filed: Apr. 12, 2010

(86) PCT No.: PCT/FR2010/050699

§ 371 (c)(1),
(2), (4) Date: Oct. 17, 2011

(87) PCT Pub. No.: WO2010/119216

PCT Pub. Date: Oct. 21, 2010

(65) Prior Publication Data

US 2012/0059650 A1 Mar. 8, 2012

(30) Foreign Application Priority Data

Apr. 17, 2009 (FR) ..... 09 52531

(51) Int. Cl.

| | |
|---|---|
| ***H04R 29/00*** | (2006.01) |
| ***G10L 25/69*** | (2013.01) |
| ***G10L 21/0208*** | (2013.01) |

(52) U.S. Cl.

CPC ..... *G10L 25/69* (2013.01); *G10L 21/0208* (2013.01)

USPC ..... 704/233; 381/94.3; 381/57; 381/94.1; 379/392; 379/390.01; 379/388.03; 704/226; 704/225; 704/215

(58) Field of Classification Search

CPC ... G10L 21/0208; G10L 19/012; G10L 15/20; G10L 19/26; G10L 2021/02085; H04M 9/08; H04M 1/19; H04G 3/32

USPC ..... 381/94.3, 94.1, 57, 317, 94.7, 104, 56, 381/106; 379/392, 390.01, 392.02, 390.02, 379/388.03; 704/226–228, 233, 225, 215

See application file for complete search history.

(56) References Cited

U.S. PATENT DOCUMENTS 5,504,473 A * 4/1996 Cecic et al. ..... 340/541
5,684,921 A * 11/1997 Bayya et al. ..... 704/226

(Continued)

FOREIGN PATENT DOCUMENTS

EP 1288914 A2 3/2003
WO 2007066049 A1 6/2007

OTHER PUBLICATIONS

International Search Report dated Jul. 13, 2010 for corresponding International Application No. PCT/FR200/050699, filed Apr. 12, 2010.

(Continued)

*Primary Examiner* — Vijay B Chawan

(74) *Attorney, Agent, or Firm* — David D. Brush; Westman, Champlin & Koehler, P.A.

(57) ABSTRACT

A method and device are provided for the objective evaluation of voice quality of a speech signal. The device includes: a module for extracting a background noise signal, referred to as a noise signal, from the speech signal; a module for calculating the audio parameters of the noise signal; a module for classifying the background noise contained in the noise signal on the basis of the calculated audio parameters, according to a predefined set of background noise classes; and a module for evaluating the voice quality of the speech signal on the basis of at least the resulting classification relative to the background noise in the speech signal.

13 Claims, 6 Drawing Sheets

(56) References Cited

U.S. PATENT DOCUMENTS

| | | | | |
|---|---|---|---|---|
| 5,771,486 | A * | 6/1998 | Chan et al. | 704/200 |
| 6,032,114 | A * | 2/2000 | Chan | 704/226 |
| 6,157,670 | A * | 12/2000 | Kosanovic | 375/227 |
| 6,330,532 | B1 * | 12/2001 | Manjunath et al. | 704/219 |
| 6,700,976 | B2 * | 3/2004 | Zhang et al. | 379/406.01 |
| 7,191,120 | B2 * | 3/2007 | Oshikiri et al. | 704/219 |
| 7,472,059 | B2 * | 12/2008 | Huang | 704/220 |
| 7,729,275 | B2 * | 6/2010 | El-Hennawey et al. | 370/252 |
| 8,095,374 | B2 * | 1/2012 | Tanrikulu | 704/500 |
| 8,305,913 | B2 * | 11/2012 | El-Hennawey et al. | 370/252 |
| 2002/0111798 | A1 * | 8/2002 | Huang | 704/220 |
| 2008/0151769 | A1 * | 6/2008 | El-Hennawey et al. | 370/252 |
| 2008/0212567 | A1 * | 9/2008 | El-Hennawey et al. | 370/352 |
| 2009/0161882 | A1 * | 6/2009 | Le Faucher et al. | 381/56 |
| 2009/0187402 | A1 * | 7/2009 | Scholl | 704/233 |
| 2012/0059650 | A1 * | 3/2012 | Faure et al. | 704/226 |

OTHER PUBLICATIONS

French Search Report and Written Opinion dated Oct. 13, 2009 for corresponding French Application No. FR 09 52531, filed Apr. 17, 2009.

Rix A W et al., "PESQ—the new ITU Standard for End-to-End Speech Quality Assessment" Audio Engineering Society Convention paper, New York, NY, US, Sep. 22, 2000, pp. 1-18, XP002262437.

A. Leman et al., "Influence of Informational Contect of Background Noise on Speech Quality Evaluation for VoIP Application" presented at the conference "Acoustics '08" in Paris, France Jun. 29, 2008 to Jul. 4, 2008.

L. Malfait et al., "P.563—The ITU-T Standard for Single-Ended Speech Quality Assessment" IEEE Transaction on Audio, Speech, and Language Processing, vol. 14(6), pp. 1924-1934, 2006.

"The E-Model, a Computational Model for Use in Transmission Planning", 2003.

* cited by examiner

METHOD AND DEVICE FOR THE OBJECTIVE EVALUATION OF THE VOICE QUALITY OF A SPEECH SIGNAL TAKING INTO ACCOUNT THE CLASSIFICATION OF THE BACKGROUND NOISE CONTAINED IN THE SIGNAL

CROSS-REFERENCE TO RELATED APPLICATIONS

This Application is a Section 371 National Stage Application of International Application No. PCT/FR2010/050699, filed Apr. 12, 2010 and published as WO 2010/119216 on Oct. 21, 2010, not in English.

STATEMENT REGARDING FEDERALLY SPONSORED RESEARCH OR DEVELOPMENT

None.

THE NAMES OF PARTIES TO A JOINT RESEARCH AGREEMENT

None.

FIELD OF THE DISCLOSURE

The present disclosure relates generally to the processing of speech signals and notably voice signals transmitted within telecommunications systems. The disclosure relates in particular to a method and a device for objective evaluation of the voice quality of a speech signal taking into account the classification of the background noises contained in the signal. The disclosure is notably applicable to the speech signals transmitted during a telephone communication via a communications network, for example a mobile telephony network or a telephony network over a switched network or over a packet network.

BACKGROUND OF THE DISCLOSURE

In the field of voice communications, the background noises included in a speech signal can include various types of noise: sounds coming from engines (automobiles, motorcycles), from aircraft passing overhead, noise from conversation/background chat—for example, in a restaurant or cafe environment—, music, and many other audible noises. In some cases, the background noises may be an additional element of the communication able to provide information useful for the listeners (mobility context, geographic location, sharing of atmosphere).

Since the advent of mobile telephones, the possibility of communicating from any given location has contributed to increasing the presence of background noises in the speech signals transmitted, and has consequently made necessary the processing of the background noise, in order to preserve an acceptable level of communication quality. Furthermore, aside from the noises coming from the environment where the sound capture takes place, electronic noise, notably produced during the coding and the transmission of the audio signal over the network (loss of packets for example, in voice-over-IP), may also interact with the background noise.

In this context, it may therefore be assumed that the perceived quality of the transmitted speech is dependent on the interaction between the various types of noise composing the background noise. Thus, the document: "*Influence of informational content of background noise on speech quality evaluation for VoIP application*" (hereafter denoted as "Document [1]"), by A. Leman, J. Faure and E. Parizet—an article presented at the conference "Acoustics '08" which was held in Paris from Jun. 29 to Jul. 4, 2008—describes subjective tests which not only show that the sound level of the background noises plays a dominant role in the evaluation of the voice quality in the framework of a voice-over-IP (VoIP) application, but also demonstrates that the type of background noises (environmental noise, line noise, etc.) which is superimposed onto the voice signal (the useful signal) plays an important role during the evaluation of the voice quality of the communication.

FIG. 1, appended to the present description, comes from the aforementioned Document [1] (see section 3.5, FIG. 2 of this document) and represents the opinion means (MOS LQSN), with the associated confidence interval, calculated from scores given by tester listeners to audio messages containing six different types of background noise, according to the ACR (Absolute Category Rating) method. The various types of noise are as follows: pink noise, stationary speech noise (SSN), electrical noise, city noise, restaurant noise, television or voice noise, each noise being considered at three different levels of perceived loudness.

The horizontal line situated above the other curves represents the score corresponding to an audio signal that contains no background noise. The scores given, "MOS LQSN"—for "Mean Opinion Score of Listening Quality obtained with Subjective method for Narrow band signals"—are in accordance with the recommendations P. 800 and P. 800.1 of the ITU-T, having respectively the titles: "*Methods for subjective determination of transmission quality*" and "*Mean Opinion Score (MOS) terminology*". As can be seen from FIG. 1, the scores given for the same useful signal (in other words the speech signal contained in the audio signal tested) vary not only according to the type of background noises contained in the audio signal, but also according to the perceived sound level (loudness) of a background noise in question.

However, the type of the background noise present in an audio signal being considered is not currently taken into account in the known methods of objective evaluation of the voice quality of a speech signal, whether this be for example the PESQ model (cf. Rec. ITU-T, P.862), the E-model (described for example in the Rec. ITU-T, G.107 "*The E-model, a computational model for use in transmission planning*", 2003), or else non-intrusive methods such as that described in the document "*P.563-The ITU-T Standard for Single-Ended Speech Quality Assessment*", by L. Malfait, J. Berger, and M. Kastner, *IEEE Transaction on Audio, Speech, and Language Processing*, vol. 14(6), pp. 1924-1934, 2006.

SUMMARY

Thus, in view of the above, there exists a real need for the availability of a model for objective evaluation of the voice quality, that takes into account the type of background noises present in an audio signal to be evaluated.

A first aspect relates to a method for objective evaluation of the voice quality of a speech signal. According to an embodiment of the invention, this method comprises the steps for:

classification of the background noises contained in the speech signal according to a predefined set of classes of background noise;

evaluation of the voice quality of the speech signal, as a function of at least the classification obtained relating to the background noises present in the speech signal.

According to an embodiment of the invention, taking into account the type of background noises present in the speech signal in the objective evaluation of the voice quality of the speech signal allows an evaluation of the quality that is closer to the subjective evaluation of the voice quality—in other words the quality actually perceived by users—than the known methods for objective evaluation of the voice quality.

According to one embodiment of the invention, the step of evaluation of the voice quality of the speech signal comprises the steps for:

estimation of the total loudness (N) of the noise signal (SIG_N);

calculation of a voice quality score as a function of the class of background noise present in the speech signal, and of the total loudness estimated for the noise signal.

In practice, a voice quality score (MOS_CLi) according to an embodiment of the invention is obtained according to a mathematical formula of the following general form:

$$\text{MOS_CLi}=C_{i-1}+C_i\times f(N)$$

where:

MOS_CLi is the score calculated for the noise signal;

$f(N)$ is a mathematical function of the total loudness, N, estimated for the noise signal;

$C_{i-1}$ and $C_i$ are two coefficients defined for the class (CLi) of background noise obtained for the noise signal.

More particularly, according to one particular embodiment of the invention, the function $f(N)$ is the natural logarithm, Ln(N), of the total loudness N expressed in sones.

In particular, according to one implementation feature of an embodiment of the invention, the total loudness of the noise signal is estimated according to an objective model for estimation of the loudness, for example the Zwicker model or the Moore model.

According to other implementation features of an embodiment of the invention, the step of classification of the background noises contained in the speech signal includes the steps for:

extraction from the speech signal of a background noise signal, referred to as noise signal;

calculation of audio parameters of the noise signal;

classification of the background noises contained in the noise signal as a function of the calculated audio parameters, according to said set of classes of background noise.

According to one particular embodiment of the invention, the step of calculation of audio parameters of the noise signal comprises the calculation of a first parameter (IND_TMP), referred to as time indicator, relating to the time variation of the noise signal, and of a second parameter (IND_FRQ), referred to as frequency indicator, relating to the frequency spectrum of the noise signal.

In practice, the time indicator (IND_TMP) is obtained from a calculation of variation of the sound level of the noise signal, and the frequency indicator (IND_FRQ) is obtained from a calculation of variation of the amplitude of the frequency spectrum of the noise signal.

The combination of these two indicators allows a low rate of classification errors to be obtained, while their calculation does not require a significant level of processing resources.

According to one particular embodiment of the aforementioned classification step, in order to carry out this classification of the background noises associated with the noise signal, the method implements steps consisting in:

comparing the value of the time indicator (IND_TMP) obtained for the noise signal with a first threshold (TH1) and determining, depending on the result of this comparison, whether the noise signal is stationary or not;

when the noise signal is identified as non-stationary, comparing the value of the frequency indicator with a second threshold (TH2) and determining, depending on the result of this comparison, whether the noise signal belongs to a first class or to a second class of background noise;

when the noise signal is identified as stationary, comparing the value of the frequency indicator with a third threshold (TH3) and determining, depending on the result of this comparison, whether the noise signal belongs to a third class or to a fourth class of background noise.

Furthermore, in this embodiment, the set of classes obtained comprises at least the following classes:

intelligible noise;

environmental noise;

blowing noise;

crackling noise.

The use of the aforementioned three thresholds TH1, TH2, TH3, in a simple tree classification structure allows a noise signal sample to be swiftly classified. Furthermore, by calculating the class of a sample over short time windows, a real-time updating of the class of background noises from the noise signal being analyzed may be obtained.

In a correlated fashion, according to a second aspect, an embodiment of the invention relates to a device for objective evaluation of the voice quality of a speech signal. According to an embodiment of the invention, this device comprises:

means of classification of the background noises contained in the speech signal according to a predefined set of classes of background noise;

means of evaluation of the voice quality of the speech signal as a function of at least the classification obtained relating to the background noises present in the speech signal.

According to particular implementation features of an embodiment of the invention, this device for objective evaluation of the voice quality comprises:

a module for extraction from the speech signal of a background noise signal, referred to as noise signal;

a module for calculation of audio parameters of the noise signal;

a module for classification of the background noises contained in the noise signal as a function of the calculated audio parameters, according to a predefined set of classes of background noise;

a module for evaluation of the voice quality of the speech signal as a function of at least the classification obtained relating to the background noises present in the speech signal.

According to another aspect, an embodiment of the invention relates to a computer program on an information media, this program comprising instructions designed for the implementation of a method such as briefly defined hereinabove, when the program is loaded and executed in a computer.

The advantages provided by the device for objective evaluation of voice quality and the aforementioned computer program are identical to those mentioned hereinabove with regard to the method for objective evaluation of the voice quality of a speech signal.

BRIEF DESCRIPTION OF THE DRAWINGS

An embodiment of the invention will be better understood with the aid of the detailed description that follows, presented with reference to the appended drawings in which.

DETAILED DESCRIPTION OF ILLUSTRATIVE EMBODIMENTS

Figure 1:
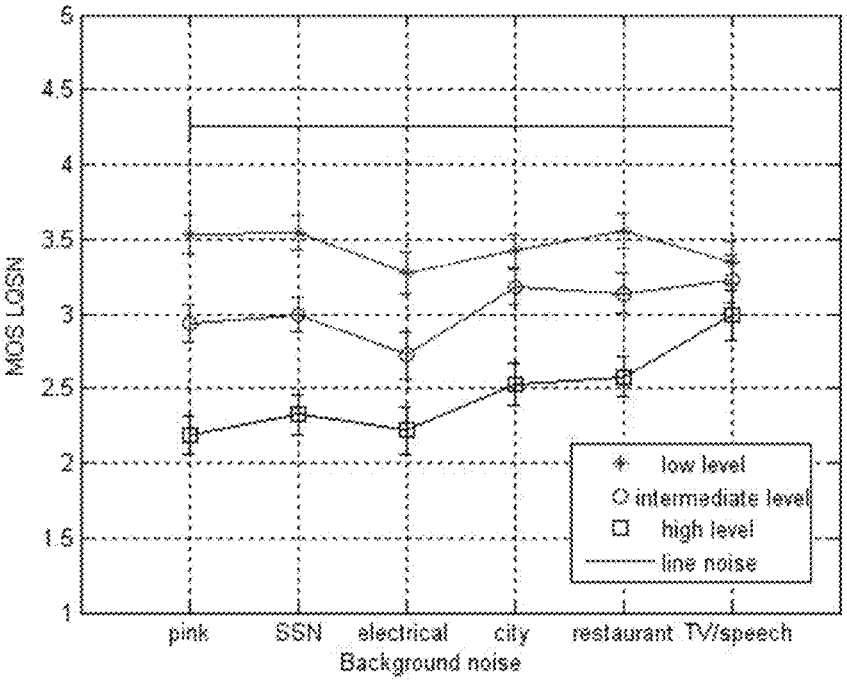
FIG. 1, already mentioned, is a graphical representation of the mean subjective scores given by tester listeners to audio messages containing various types of background noise and according to several levels of loudness, according to a known study from the prior art.

The method for objective evaluation of the voice quality of a speech signal according to an embodiment of the invention is noteworthy in that it uses the result of the phase for classification of the background noises contained in the speech signal in order to estimate the voice quality of the signal. The phase for classification of the background noises contained in the speech signal is based on the implementation of a previously constructed method for classification of background noise components, and whose mode of construction according to an embodiment of the invention is described hereinafter.

1. Construction of the Model for Classification of the Background Noise Components The construction of a model for noise classification is conventionally undertaken according to three successive phases. The first phase consists in determining a sound database composed of audio signals containing various background noises, each audio signal being labeled as belonging to a given noise class. Subsequently, during a second phase, a certain number of predefined characteristic parameters are extracted from each sound sample in the database forming a set of indicators. Finally, during the third phase, called learning phase, the set of the pairs, each composed from the set of indicators and from the associated noise class, is supplied to a learning engine designed to deliver a classification model allowing any given sound sample to be classified on the basis of given indicators, the latter being selected as being the most relevant from amongst the various indicators used during the learning phase. The classification model obtained then enables, using indicators extracted from any given sound sample (not belonging to the sound database), a noise class to be provided to which this sample belongs.

In the aforementioned Document [1], it is demonstrated that the voice quality may be influenced by the significance of the noise in the context of telephony. Thus, if users identify noise as coming from a sound source in the environment of the speaker, a certain indulgence is observed in relation to the evaluation of the perceived quality. Two tests have enabled this fact to be verified; the first test relating to the interaction of the characteristics and sound levels of the background noises with the perceived voice quality, and the second test relating to the interaction of the characteristics of the background noises with the degradations due to the transmission of voice-over-IP. Starting from the results of the study divulged in the aforementioned document, the inventors of the present invention have tried to define parameters (indicators) of an audio signal allowing the significance of the background noises present in this signal to be measured and to be quantified and then a statistical method for classification of the background noises to be defined depending on the chosen indicators.

Phase 1—Composition of a Sound Database of Audio Signals

For the construction of the classification model of an embodiment of the present invention, the sound database used is constituted, on the one hand, from the audio signals having been used for the subjective tests described in the Document [1] and, on the other hand, from audio signals coming from public sound databases.

With regard to the audio signals coming from the aforementioned subjective tests, in the first test (see Document [1], section 3.2), 152 sound samples are used. These samples are obtained from eight phrases of the same duration (8 seconds) selected from a normalized list of double phrases, produced by four speakers (two men and two women). These phrases are then mixed with six types of background noises (detailed hereinbelow) at three different levels of loudness. Phrases without background noises are also included. Subsequently, all of the samples are encoded with a codec G.711. The results of this first test are illustrated in FIG. 1 described above.

In the second test (see Document [1], section 4.1), the same phrases are mixed with the six types of background noises with an average loudness level, then four types of degradations due to the transmission of voice-over-IP are introduced (codec G.711 with 0% and 3% loss of packets; codec G.729 with 0% and 3% loss of packets). In total, 192 sound samples are obtained according to the second test.

The six types of background noise used in relation to the aforementioned subjective tests are as follows:

- a pink noise, considered as the reference (stationary noise with −3 dB/octave of frequency content);
- a stationary speech noise (SSN), in other words a random noise with a frequency content similar to the standardized human voice (stationary);
- an electrical noise, in other words a harmonic sound having a fundamental frequency of 50 Hz simulating a circuit noise (stationary);
- an environmental city noise with presence of automobiles, audible warnings, etc. (non-stationary);
- an environmental restaurant noise with presence of background chat, noise of glasses, laughing, etc. (non-stationary);
- a sound of intelligible voices recorded from a TV source (non-stationary).

All the sounds are sampled at 8 kHz (16 bits), and an IRS (Intermediate Reference System) band-pass filter is used to simulate a real telephone network. The six types of noise mentioned hereinabove are repeated with degradations linked to the codings G.711 and G.729, with packet losses, together with several levels of scattering.

Regarding the audio signals coming from public sound databases, used to complete the sound database, these consist of 48 other audio signals comprising various noises, such as for example line noise, noises from wind, automobiles, vacuum cleaners, hairdryers, babble, noises coming from the natural environment (birds, running water, rain, etc.), and music.

These 48 noises have then been subjected to six degradation conditions, as explained hereinafter.

Each noise is sampled at 8 kHz, filtered with the IRS8 tool, coded and decoded in G.711 and also G.729 in the case of narrowband (300-3400 Hz), then each sound is sampled at 16 kHz, then filtered with the tool described in the recommendation P.341 of the UIT-T ("*Transmission characteristics for wideband* (150-7000 *Hz*) *digital hands-free telephony terminals*", 1998), and lastly coded and decoded in G.722 (wideband 50-7000 Hz). These three degraded conditions are then restored according to two levels whose signal-to-noise ratios (SNR) are respectively 16 and 32. Each noise lasts four seconds. A total of 288 different audio signals are finally obtained.

Thus, the sound database used to develop the classification model is finally composed of 632 audio signals.

Each sound sample in the sound database is manually labeled to identify a class of background noise to which it belongs. The classes chosen have been defined based on the subjective tests mentioned in the Document [1] and, more precisely, have been determined according to the indulgence with respect to the perceived noises manifested by the human subjects tested when the voice quality is judged as a function of the type of background noise (from amongst the aforementioned 6 types).

Thus, four classes of background noise (BGN) have been chosen:

Class 1: "intelligible" BGN—these are noises of an intelligible nature such as music, speech, etc. This class of background noises causes a strong indulgence on the judgment of the perceived voice quality, with respect to a blowing noise of the same level.

Class 2: "environmental" BGN—these are noises having informational content and providing information on the environment of the speaker, such as noises from the city, restaurant, nature, etc. This noise class causes a slight indulgence on the judgment of the voice quality perceived by the users with respect to a blowing noise of the same level.

Class 3: "blowing" BGN—these noises are of a stationary nature and do not contain any informational content, this could for example be pink noise, stationary wind noise, stationary speech noise (SSN).

Class 4: "crackling" BGN—these are noises not containing any informational content, such as electrical noise, non-stationary noisy noise, etc. This noise class causes a significant degradation of the voice quality perceived by the users, with respect to a blowing noise of the same level.

Phase 2—Extraction of Parameters from the Audio Signals in the Sound Database

For each of the audio signals in the sound database, eight parameters or indicators known per se are calculated. These indicators are as follows:

(1) The correlation of the signal: this is an indicator using the Bravais-Pearson correlation coefficient applied between the entire signal and the same signal offset by one digital sample.

(2) The zero-crossing rate (ZCR) of the signal;

(3) The variation of the acoustic level of the signal;

(4) The spectral center of gravity (or Spectral Centroid) of the signal;

(5) The spectral roughness of the signal;

(6) The spectral flux of the signal;

(7) The spectral cut-off point (or Spectral Roll-off Point) of the signal;

(8) The harmonic coefficient of the signal.

Phase 3—Development of the Classification Model

The classification model is obtained through a learning process by means of a decision tree (cf. FIG. 1), carried out using the statistical tool called "classregtree" from the MATLAB® environment marketed by The MathWorks company. The algorithm used is developed based on techniques described in the book entitled "*Classification and regression trees*" by Leo Breiman et al. published by Chapman and Hall in 1993.

Each sample of background noise in the sound database is identified by the aforementioned eight indicators and the class to which the sample belongs (1: intelligible; 2: environment; 3: blowing; 4: crackling). The decision tree then calculates the various possible solutions in order to obtain an optimum classification that comes closest to the classes labeled manually. During this learning phase, the most relevant audio indicators are selected, and value thresholds associated with these indicators are defined, these thresholds allowing the various classes and sub-classes of background noises to be separated.

During the learning phase, 500 background noises of various types are randomly chosen from amongst the 632 in the sound database. The result of the classification obtained by learning is shown in FIG. 1.

Figure 2:
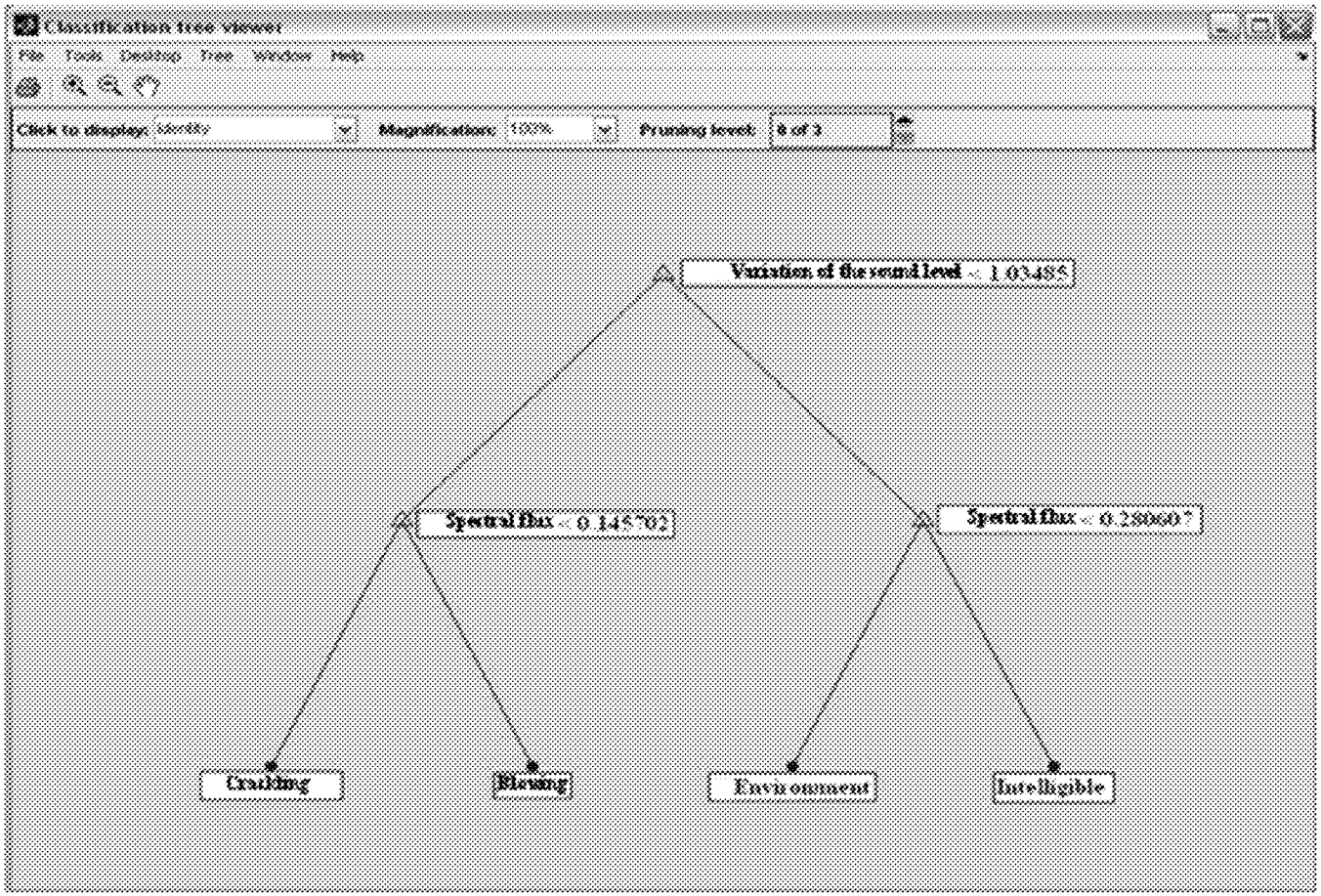
FIG. 2 shows a software window displayed on a computer screen showing the selection tree obtained by learning for defining a model for classification of background noises components used according to an embodiment of the invention.

As can be seen in the decision tree shown in FIG. 2, the resulting classification only uses two indicators from amongst the eight initial ones in order to classify the 500 background noises from the learning phase into the four predefined classes. The indicators selected are the indicators (3) and (6) from the list introduced above and respectively represent the variation of the acoustic level and the spectral flux of the background noise signals.

As shown in FIG. 2, the classification model obtained by learning starts by separating the background noises according to whether they are stationary or not. This 'stationarity property' is identified by the characteristic time indicator for the variation of the acoustic level (indicator (3)). Thus, if this indicator has a value lower than a first threshold—TH1=1.03485—then the background noise is considered as stationary (left branch), otherwise the background noise is considered as non-stationary (right branch). Subsequently, the characteristic frequency indicator of the spectral flux (indicator (6)) filters in turn each of the two categories (stationary/non-stationary) selected with the indicator (3).

Thus, when the noise signal is considered as non-stationary, if the frequency indicator is lower than a second threshold—TH2=0.280607—then the noise signal belongs to the class "environment", otherwise the noise signal belongs to the class "intelligible". On the other hand, when the noise signal is considered as stationary, if the frequency indicator (indicator (6), spectral flux) is lower than a third threshold—TH3=0.145702—then the noise signal belongs to the class "crackling", otherwise the noise signal belongs to the class "blowing".

The selection tree (FIG. 1), obtained with the aforementioned two indicators, has allowed 86.2% of the background noises signals to be correctly classified from amongst the 500 audio signals subjected to the learning process. More precisely, the proportions of accurate classification obtained for each class are as follows:

100% for the class "crackling", 96.4% for the class "blowing", 79.2% for the class "environment", 95.9% for the class "intelligible".

It should be noted that the class "environment" achieves an accurate classification result that is lower than that of the other classes. This result is due to the choice between noises for "blowing" and for "environment" which can sometimes be difficult to differentiate, because of the resemblance of certain sounds that may be arranged in both or either of these two classes, for example sounds such as the noise of the wind or the noise of a hair-dryer.

Hereinafter, the indicators selected for the classification model according to an embodiment of the invention are defined in more detail.

The time indicator, denoted in the following part of the description by "IND_TMP", is characteristic of the variation of the sound level of the any given noise signal and is defined by the standard deviation of the values of the powers of all the frames considered for the signal. In a first step, a power value is determined for each of the frames. Each frame is composed of 512 samples, with an overlap between successive frames of 256 samples. For a sampling frequency of 8000 Hz, this corresponds to a duration of 64 ms (milliseconds) per frame, with a overlap of 32 ms. This 50% overlap is used to obtain a continuity between successive frames, as defined in the Document [5]: "*P.56 Objective measurement of the active voice level*", recommendation of the ITU-T, 1993.

When the noise to be classified has a length greater than a frame, the acoustic power value for each of the frames may be defined by the following mathematical formula:

$$P(\text{frame}) = 10\log\left(\frac{1}{L_{frame}}\sum_{i=1}^{L_{frame}} x_i^2\right) \tag{1}$$

where: "frame" denotes the number of the frame to be evaluated; "$L_{frame}$" denotes the length of the frame (512 samples); "$x_i$" corresponds to the amplitude of the sample i; "log" denotes the logarithm base 10. The logarithm of the mean is thus calculated in order to obtain a power value per frame.

The value of the time indicator "IND_TMP" of the background noise in question is then defined by the standard deviation of all the power values obtained, by the following equation:

$$\text{IND_TMP} = \sqrt{\frac{1}{Nframe}\sum_{i=1}^{Nframe}(P_i - \langle P\rangle)^2} \tag{2}$$

where: $N_{frame}$ represents the number of frames present in the background noise in question; $P_i$ represents the power value for the frame i; and <P> corresponds to the mean power over all the frames.

According to the time indicator IND_TMP, the more a sound is non-stationary, the greater the value obtained for this indicator.

The frequency indicator, denoted in the following part of the description by "IND_FRQ" and characteristic of the spectral flux of the noise signal, is calculated from the Spectral Power Density (SPD) of the signal. The SPD of a signal—coming from the Fourier transform of the autocorrelation function of the signal—allows the spectral envelope of the signal to be characterized, so as to obtain information on the frequency content of the signal at a given moment in time, such as for example the formants, the harmonics, etc. According to the present embodiment, this indicator is determined per frame of 256 samples, corresponding to a period of 32 ms for a sampling frequency of 8 KHz. In contrast to the time indicator, there is no overlap of the frames.

The spectral flux (SF), also denoted by "variation in the amplitude of the spectrum", is a measurement allowing the speed of variation of a power spectrum of a signal over time to be evaluated. This indicator is calculated from the normalized cross-correlation between two successive amplitudes of the spectrum $a_k(t-1)$ and $a_k(t)$. The spectral flux (SF) may be defined by the following mathematical formula:

$$SF(\text{frame}) = 1 - \frac{\sum_k a_k(t-1)\cdot a_k(t)}{\sqrt{\sum_k a_k(t-1)^2}\sqrt{\sum_k a_k(t)^2}} \tag{3}$$

where: "k" is an index representing the various frequency components, and "t" an index representing the successive frames with no overlap, composed of 256 samples each.

In other words, a value of the spectral flux (SF) corresponds to the difference in amplitude of the spectral vector between two successive frames. This value is close to zero if the successive spectra are similar, and is close to 1 for successive spectra that are very different. The value of the spectral flux is high for a music signal, since a musical signal varies greatly from one frame to the next. For speech, with the alternating periods of stability (vowel) and of transitions (consonant/vowel), the measurement of the spectral flux takes values that are very different and vary greatly in the course of a phrase.

When the noise to be classified has a length that is greater than a frame, the final expression taken for the frequency indicator is defined as the mean of the values of spectral flux for all the frames of the signal, as defined in the equation hereinafter:

$$\text{IND_FRQ} = \frac{1}{Nframe}\sum_{i=1}^{Nframe} SF(i) \tag{4}$$

2. Use of the Model for Classification of Background Noise Components

The classification model of an embodiment of the invention, obtained as presented hereinabove, is used according to an embodiment of the invention to determine, on the basis of indicators extracted for any given noisy audio signal, the noise class to which this noisy signal belongs from amongst the set of classes defined for the classification model.

Figure 3A:
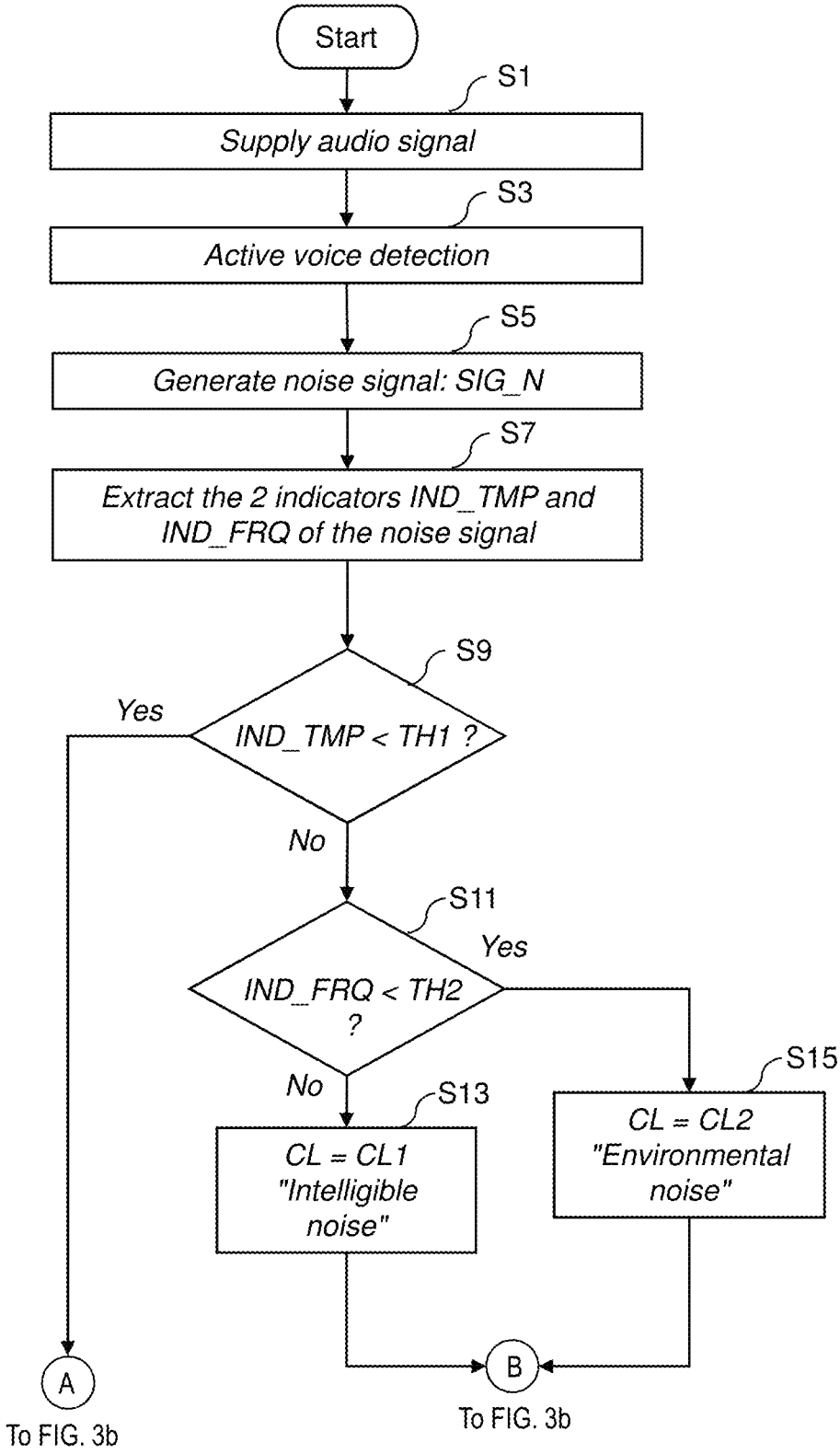
FIGS. 3*a* and 3*b* show a flow diagram illustrating a method for objective evaluation of the voice quality of a speech signal, according to one embodiment of the invention.
Figure 3B:
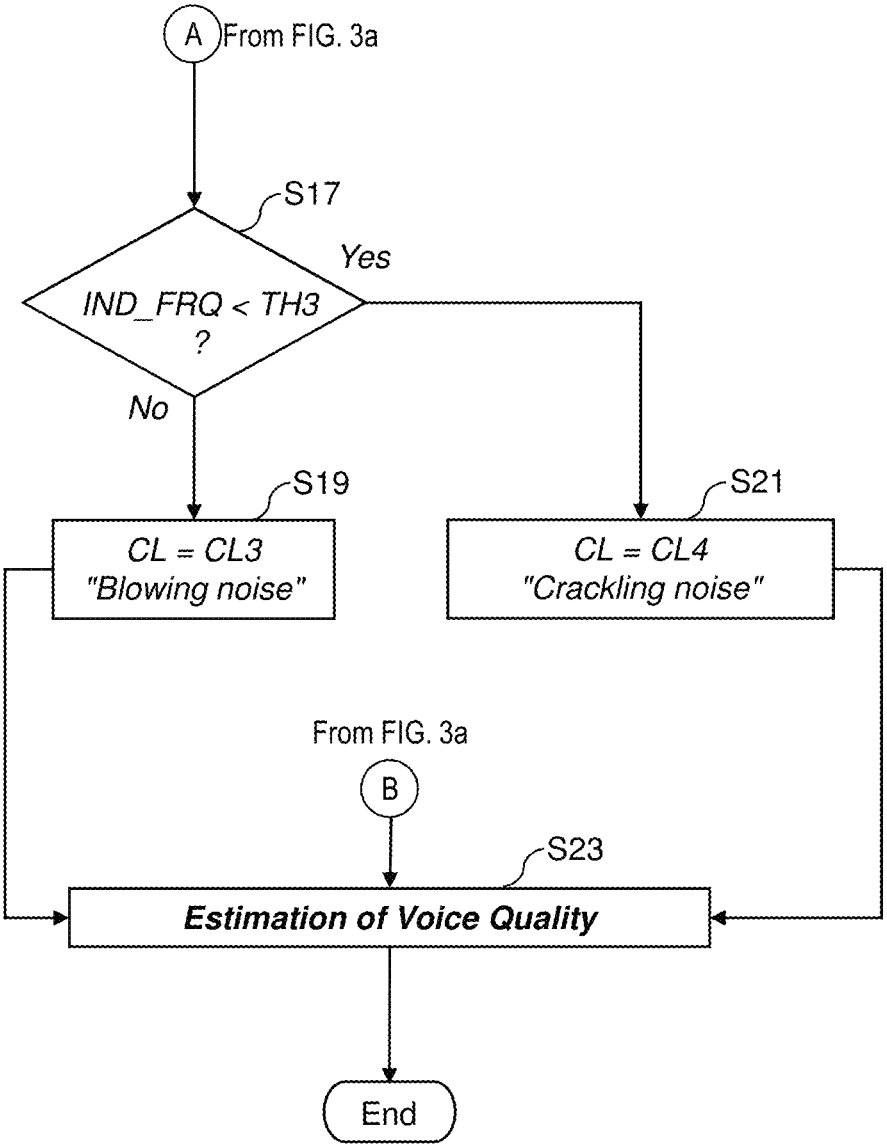

FIGS. 3*a* and 3*b* show a flow diagram illustrating a method for objective evaluation of the voice quality of a speech signal, according to one embodiment of the invention. According to an embodiment of the invention, the method for classification of background noises is implemented prior to the phase for evaluation of the voice quality proper.

As shown in FIG. 3*a*, the first step S1 consists in obtaining an audio signal, which, in the embodiment presented here, is a speech signal obtained in an analog or digital form. In this embodiment, as illustrated by the step S3, an operation for detection of voice activity (DVA) is then applied to the speech signal. The aim of this detection of voice activity is to separate, in the input audio signal, the periods of the signal containing speech, potentially noisy, from the periods of the signal not containing speech (periods of silence), so which can only contain noise. Thus, during this step, the active regions of the signal, in other words containing the noisy voice message, are separated from the noisy inactive regions. In practice, in this embodiment, the technique for detection of voice activity implemented is that described in the aforementioned Document [5] ("*P.56 Objective measurement of the active voice level*", recommendation of the ITU-T, 1993).

In summary, the principle of the DVA technique used consists in:

detecting the envelope of the signal, comparing the envelope of the signal with a fixed threshold taking into account a hold time for the speech, determining the signal frames whose envelope is situated above the threshold (DVA=1 for the active frames) and below (DVA=0 for the background noise). This threshold is fixed at 15.9 dB (decibels) below the mean active voice level (power of the signal over the active frames).

Once the voice detection has been carried out on the audio signal, the background noise signal generated (step S5) is the signal composed of the periods of the audio signal for which the result of the detection of voice activity is zero.

After the noise signal has been generated, the audio parameters composed of the two aforementioned indicators (time indicator IND_TMP and frequency indicator IND_FRQ), which have been selected during the development of the classification model (learning phase), are extracted from the noise signal during the step S7.

Subsequently, the tests S9, S11 (FIG. 3*a*) and S17 (FIG. 3*b*) and the associated decision branches correspond to the decision tree described above in relation to FIG. 2. Thus, in the step S9, the value of the time indicator (IND_TMP) obtained for the noise signal is compared with the aforementioned first threshold TH1. If the value of the time indicator is greater than the threshold TH1 (S9, no), then the noise signal is of the non-stationary type and the test in step S11 is then applied.

During the test S11, the frequency indicator (IND_FRQ) is, this time, compared with the aforementioned second threshold TH2. If the indicator IND_FRQ is greater (S11, no) than the threshold TH2, the class (CL) of the noise signal is determined (step S13) as being CL1: "Intelligible noise"; otherwise the class of the noise signal is determined (step S15) as being CL2: "Environmental noise". The classification of the noise signal analyzed is then finished and the evaluation of the voice quality of the speech signal can then be carried out (FIG. 3*b*, step S23).

When the initial test S9 is applied, if the value of the time indicator is lower than the threshold TH1 (S9, yes) then the noise signal is of the stationary type and the test in the step S17 (FIG. 3*b*) is then applied. In the test S17, the value of the frequency indicator IND_FRQ is compared with the third threshold TH3 (defined above). If the indicator IND_FRQ is greater (S17, no) than the threshold TH3, the class (CL) of the noise signal is determined (step S19) as being CL3: "Blowing noise"; otherwise the class of the noise signal is determined (step S21) as being CL4: "Crackling noise". The classification of the noise signal analyzed is then finished and the evaluation of the voice quality of the speech signal can then be carried out (FIG. 3*b*, step S23).

Figure 4:
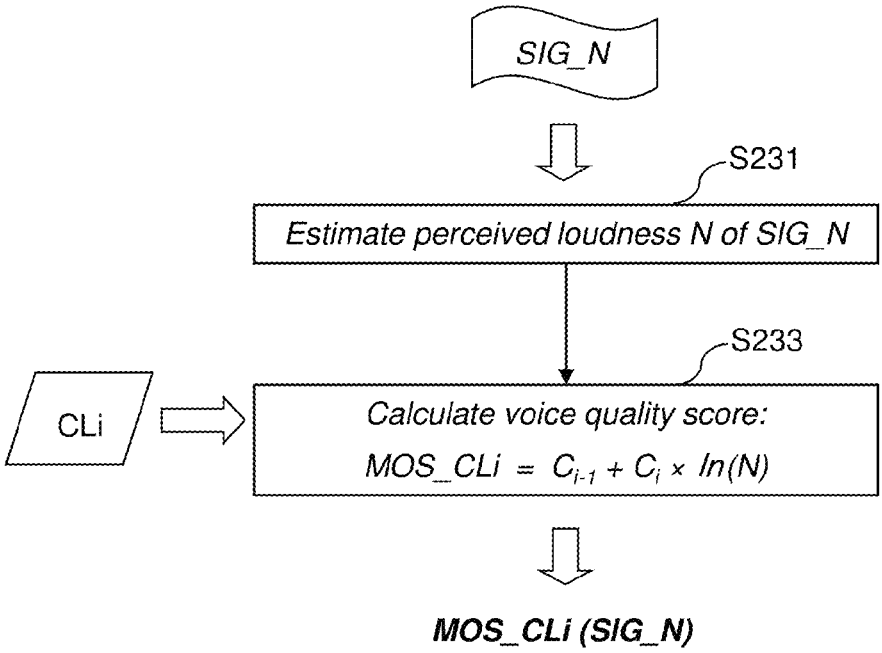
FIG. 4 is a flow diagram detailing the step (FIG. 3*b*, S23) for evaluation of the voice quality of a speech signal as a function of the classification of the background noises contained in the speech signal.

FIG. 4 details the step (FIG. 3*b*, S23) for evaluation of the voice quality of a speech signal according to the classification of the background noises contained in the speech signal. As shown in FIG. 4, the operation for evaluation of the voice quality commences with the step S231 during which the total loudness of the noise signal (SIG_N) is estimated.

It is recalled here that the loudness is defined as the subjective intensity of a sound; it is expressed in sones or in phones. The total loudness measured in a subjective manner (perceived loudness) may however be estimated by using known objective models such as the Zwicker model or the Moore model.

The Zwicker model is described for example in the document entitled "*Psychoacoustics: Facts and Models*", by E. Zwicker and H. Fastl—Berlin, Springer, 2nd updated edition, Apr. 14, 1999.

The Moore model is described for example in the document: "*A Model for the Prediction of Thresholds, Loudness, and Partial Loudness*", by B. C. J. Moore, B. R. Glasberg and T. Baer—Journal of the Audio Engineering Society 45(4): 224-240, 1997.

In the framework of the embodiment presented here, the total loudness of the noise signal is estimated by using the Zwicker model, however an embodiment of the invention can also be implemented by using the Moore model. Furthermore, the more accurate the objective model for estimation of the loudness used, the better the evaluation will be of the voice quality according to an embodiment of the invention.

The estimation of the total loudness, expressed in sones, of the noise signal SIG_N, obtained using the Zwicker model, is denoted here by: "N". Thus, when the step S231 shown in FIG. 4 is finished, an estimation of the loudness of the noise signal is obtained.

The step S233 that follows is the actual step of evaluation of the voice quality of the speech signal. According to the method, the first step is to select, from four, one mathematical formula to be employed, depending on the noise class CLi (i=1, 2, 3, 4) obtained during the initial phase for classification of the background noises (obtaining the aforementioned formulae is detailed hereinbelow).

The general expression for the selected formula is the following:

$$\text{MOS_CLi}=C_{i-1}+C_i\times f(N) \tag{5}$$

where:

MOS_CLi is the score calculated for the noise signal SIG_N of class CLi;

$f(N)$ is a mathematical function of the total loudness, N, estimated for the noise signal, according to a model for loudness such as the Zwicker model;

$C_{i-1}$ and $C_i$ are two coefficients defined for the mathematical formula associated with the class CLi.

The mathematical expression for the formula (5) hereinabove highlights the fact that, according to an embodiment of the invention, there is a model for evaluation of voice quality for each class of background noise (CL1-CL4) which is a function of the total loudness of the background noise.

Thus, in the embodiment presented here, the voice quality score for the speech signal, MOS_CLi, is obtained, on the one hand, as a function of the classification obtained relating to the background noises present in the speech signal—by the choice of the coefficients ($C_{i-1}$; $C_i$) of the mathematical formula which correspond to the class of the background noises—and on the other hand, as a function of the loudness N estimated for the background noise.

3. Obtaining the Models for Evaluation of Voice Quality by Class of Background Noise The mode of development of the models for evaluation of voice quality for each class of background noises (CL1-CL4) will now be detailed. FIG. 1, described above and coming from the aforementioned Document [1], shows the opinion means (MOS LQSN), with the associated confidence interval, calculated from scores given by tester listeners to audio messages containing six different types of background noise, according to the ACR (Absolute Category Rating) method. The various types of noise are as follows: pink noise, stationary speech noise (SSN), electrical noise, city noise, restaurant noise, television or voice noise, each noise being considered at three different levels of perceived loudness. The levels of loudness for the various types of background noise are obtained in this test in a subjective manner.

More precisely, the sound database used in relation to the first test described in the Document [1] (see section 2 of the document), is composed of eight phrases, half of which are spoken by two men and the other half by two women. Each of these spoken phrases constitutes a speech signal (8 speech signals). Subsequently, each of the aforementioned six background noises is added to each of these speech signals, and 48 noisy speech signals (8 signals per type of background noise) are obtained. During the test, each of these noisy speech signals is played for the tester listeners to listen to according to three different levels of iso-loudness, which makes 144 different noisy signals in total. Furthermore, pink background noises (SNR=44) is added to each of the 8 initial speech signals (spoken phrase), in order to represent the condition corresponding to a speech signal without background noise. In all, 152 speech signals have been used for the first test.

With regard to the levels of iso-loudness used, these have been determined in a preliminary step according to the "Adjustment test" for the first test described in the Document [1] (Section 2). This loudness adjustment test conforms to the results described in the document entitled "The loudness of pulsed sounds: Perception, Measurements and Models", Thesis of Isabelle Boullet—Université d'Aix-Marseille 2, 2005. In short, this test consists in asking the individuals to modify the level of each noise signal in such a manner that the loudness of the signal is equal to the loudness of the reference signal which is the pink noise. In practice, the three levels of loudness (expressed in sones) determined for each of the six types of background noises employed are the following: 4.6 sones; 8.2 sones; 14 sones. The level of loudness for each of the reference speech signals, without background noises (in other words only containing pink noise with SNR=44) is 1.67 sones.

Based on the results of the test illustrated in FIG. 1, the six types of background noise used have enabled the four classes of background noises used according to an embodiment of the invention to be defined in the following manner:

class 1 (CL1: "intelligible") corresponds to the noises from TV/voices;

class 2 (CL2: "environment") corresponds to the combination of the city noises and restaurant noises;

class 3 (CL3: "blowing") combines the pink noise and the stationary speech noise (SSN); and class 4 (CL4: "crackling") corresponds to electrical noises.

Thus, each test audio signal can be characterized by its class of background noises (CL1-CL4), its level of perceived loudness (in sones: 1.67; 4.6; 8.2; 14) and the score MOS-LQSN (Listening Quality Subjective Narrowband) which has been assigned to it during the preliminary subjective test (Document [1], "Preliminary Experiment"). Consequently, in summary, during this test, 24 subjects have been subjected to a test for evaluation of the overall quality of audio signals, according to the ACR method. In the end, 152 scores MOS-LQSN have been obtained by taking the mean of the scores assigned by the 24 subjects, for each of the 152 audio test signals, which signals are organized according to the four classes of background noises defined according to an embodiment of the invention.

Figure 5:
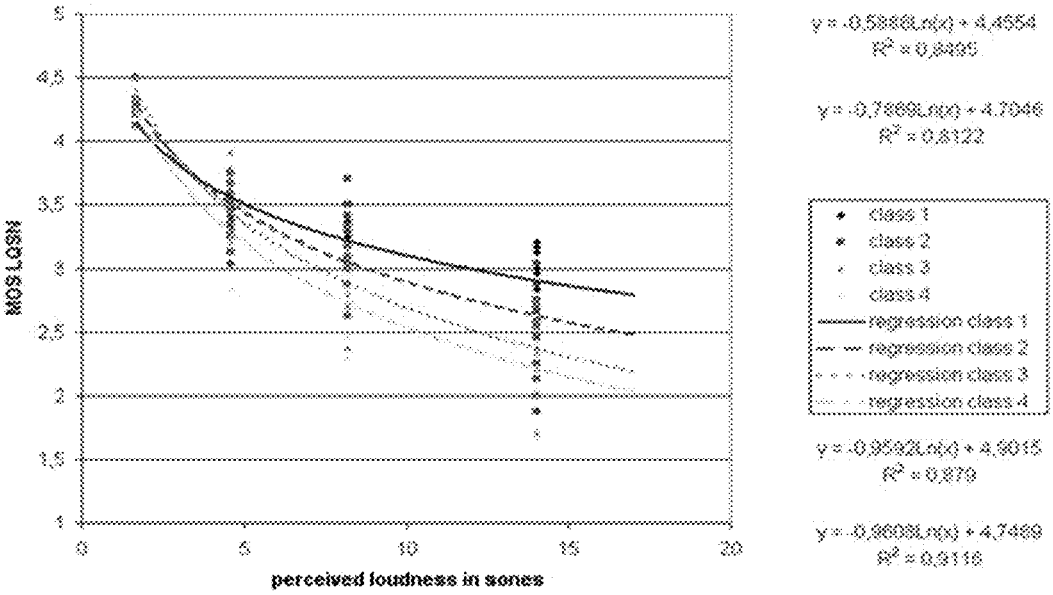
FIG. 5 shows graphically the result of subjective tests for evaluation of the voice quality according to an embodiment of the invention, together with the curves obtained by logarithmic regression, which links the scores for perceived quality to the perceived loudness for audio signals corresponding to the classes of background noise defined according to an embodiment of the invention.

FIG. 5 shows graphically the result of the aforementioned subjective tests. The 152 test conditions are represented by their points, where each point corresponds, in abscissa, to a loudness level, and in ordinate, to the assigned quality score (MOS-LQSN); the points are furthermore differentiated according to the class of the background noises contained in the corresponding audio signal.

According to an embodiment of the invention, starting from the cloud of points generated by the subjective tests, the modeling of the evaluation of the voice quality by class of background noise has been obtained by mathematical regression. In practice, several types of regression have been tested (polynomial and linear regression), but it is logarithmic regression as a function of the perceived loudness, expressed in sones, that allows the best correlations with the scores on perceived voice quality to be obtained.

In FIG. 5, the curves obtained by logarithmic regression can be observed linking the perceived quality scores to the perceived loudness, expressed in sones, for audio signals corresponding to the classes of background noise defined according to an embodiment of the invention. FIG. 5 also indicates the equations obtained for each of the four curves obtained by logarithmic regression. Thus, the first equation at the top right corresponds to the class 1, the second to the class 2, the third to the class 3, and the fourth to the class 4.

For each of these equations, the value associated with $R^2$ corresponds to the correlation coefficient between the results coming from the subjective test and the corresponding logarithmic regression.

Thus, in practice, the equation (5) presented above is expressed for the various classes as follows:

$$MOS_CLi=C_{i-1}+C_i\times\ln(N) \quad (6)$$

with:

Ln(N): natural logarithm of the value of total loudness, N, calculated and expressed in sones;

$(C_{i-1}; C_i)=(4.4554; -0.5888)$ for i=1 (class 1);

$(C_{i-1}; C_i)=(4.7046; -0.7869)$ for i=2 (class 2);

$(C_{i-1}; C_i)=(4.9015; -0.9592)$ for i=3 (class 3);

$(C_{i-1}; C_i)=(4.7489; -0.9608)$ for i=4 (class 4);

In the framework of the model for objective evaluation of the voice quality according to an embodiment of the invention, the value of perceived loudness N—value obtained subjectively in the framework of the aforementioned subjective tests—is obtained by estimation according to a known method for estimation of loudness, namely the Zwicker model in the embodiment presented here.

Figure 6:
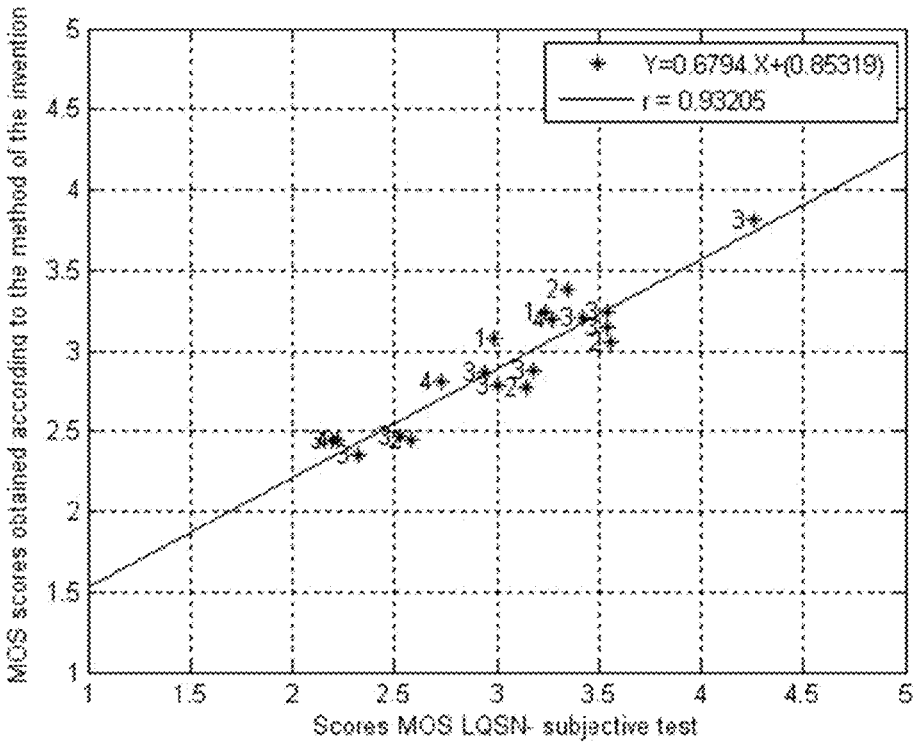
FIG. 6 shows graphically the degree of correlation existing between the quality scores obtained during the subjective tests and those obtained according to the method for objective evaluation of the quality according to an embodiment of the present invention.

FIG. 6 shows graphically the degree of correlation existing between the quality scores obtained during the subjective tests and those obtained using the method for objective evaluation of the quality, according to an embodiment of the present invention. As can be seen in FIG. 6, a very good correlation, of around 93% (r=0.93205), is obtained between the scores MOS-LQSN coming from the subjective test presented above (abscissa axis), and the objective scores MOS (ordinate axis) obtained with the quality evaluation model according to an embodiment of the invention, such as defined by the equation (6) above.

Figure 7:
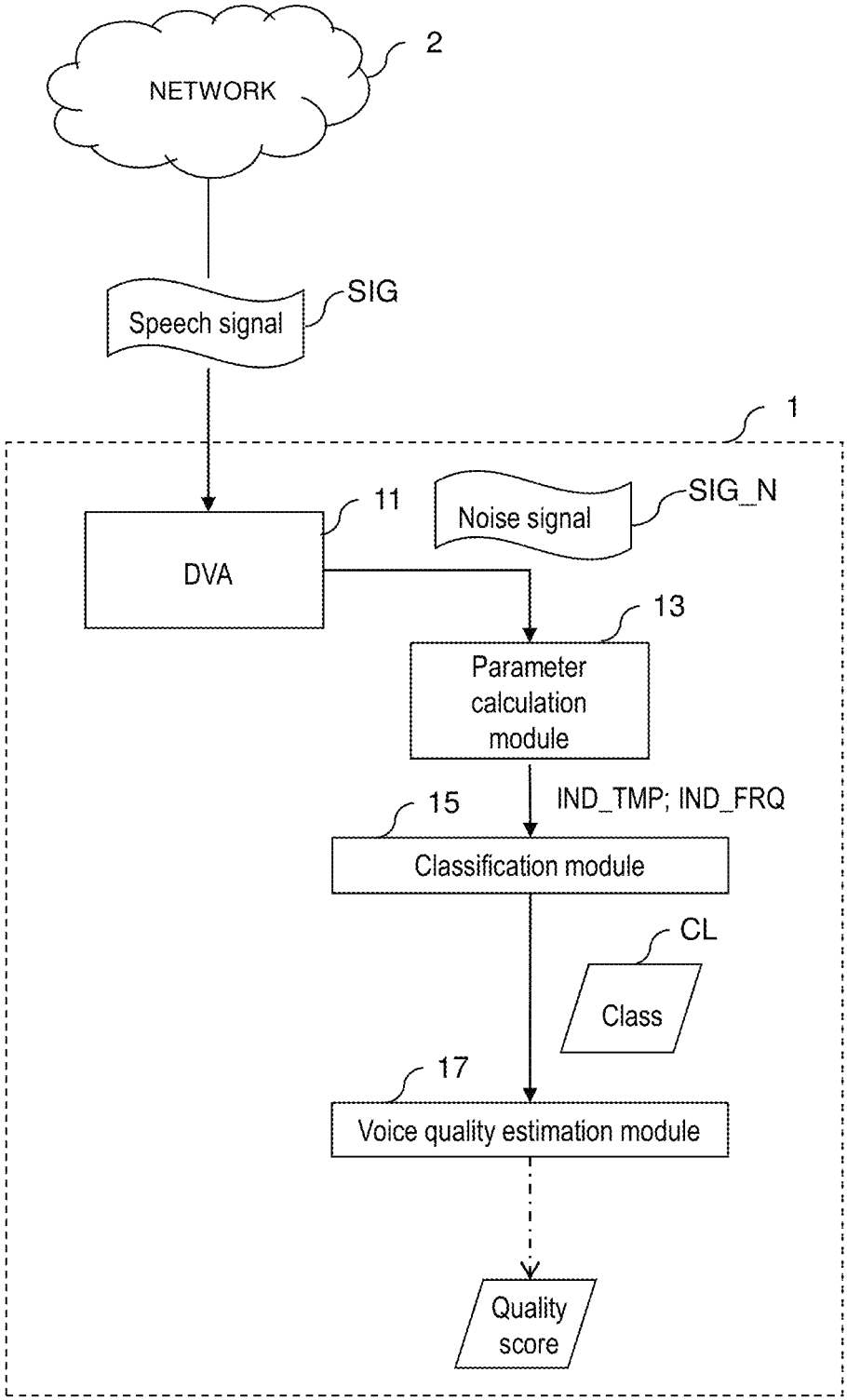
FIG. 7 shows an operational flow diagram of a device for objective evaluation of the voice quality of a speech signal according to an embodiment of the invention.

In relation to FIG. 7, a functional description of a device for objective evaluation of the voice quality of a speech signal, according to an embodiment of the invention, will now be presented. This voice quality evaluation device is designed to implement the voice quality evaluation method according to an embodiment of the invention which has just been described hereinabove.

As shown in FIG. 7, the device 1 for evaluation of the voice quality of a speech signal comprises a module 11 for extraction from the audio signal (SIG) of a background noise signal (SIG_N), referred to as noise signal.

The speech signal (SIG), supplied at the input of the voice quality evaluation device 1, may be delivered to the device 1 from a communications network 2, such as a voice-over-IP network for example.

According to the present embodiment, the module 11 is in practice a module for detection of voice activity. The module DVA 11 then supplies a noise signal SIG_N which is delivered to the input of a parameter extraction module 13, in other words a module calculating the parameters comprising the time and frequency indicators IND_TMP and IND_FRQ, respectively. The calculated indicators are then supplied to a classification module 15, implementing the classification model according to an embodiment of the invention, described above, and which determines, as a function of the values of the indicators used, the class of background noise (CL) to which the noise signal SIG_N belongs, according to the algorithm described in relation to FIGS. 3*a* and 3*b*.

The result of the classification carried out by the module 15 for classification of background noises is then supplied to the voice quality evaluation module 17. The latter implements the voice quality evaluation algorithm described above in relation to FIG. 4, in order to finally deliver an objective voice quality score relating to the input speech signal (SIG).

In practice, the voice quality evaluation device according to an embodiment of the invention is implemented in the form of software means, in other words computer program modules, performing the functions described with reference to FIGS. 3*a*, 3*b*, 4 and 5.

Furthermore, with regard to a particular implementation of an embodiment of the invention, the voice quality evaluation module 17 can be incorporated into a computer system distinct from that accommodating the other modules. In particular, the information on class of background noise (CL) can be communicated via a communications network to the machine or server responsible for carrying out the evaluation of the voice quality. Furthermore, according to a particular application of the invention, in the field for example of the supervision of the voice quality over a communications network, each voice quality score calculated by the module 17 is sent to a unit of equipment for local acquisition or over the network, responsible for collecting this quality information with a view to establishing an overall quality score, established for example as a function of time and/or as a function of the type of communication and/or as a function of other types of quality scores.

The aforementioned program modules are implemented when they are loaded and executed in a computer or computing device. Such a computing device can also be formed by any system with a processor, integrated into a communications terminal or into communications network equipment.

It will also be noted that a computer program according to an embodiment of the invention, whose ultimate purpose is the implementation of the invention when it is executed by a suitable computer system, may be stored on information media of various types. Indeed, such information media may correspond to any given unit or device capable of storing a program according to an embodiment of the invention.

For example, the media in question can comprise a hardware means of storage, such as a memory, for example a CD ROM or a memory of the ROM or RAM type of microelectronic circuit, or else a means of magnetic recording, for example a hard disk.

From the design point of view, a computer program according to an embodiment of the invention can use any type of programming language and be in the form of source code, object code, or of code intermediate between source code and object code (e.g., a partially compiled form), or in any other desired form for implementing a method according to an embodiment of the invention.

Although the present disclosure has been described with reference to one or more examples, workers skilled in the art will recognize that changes may be made in form and detail without departing from the scope of the disclosure and/or the appended claims.

The invention claimed is:

1. A method for objective evaluation of voice quality of a speech signal, wherein the method comprises the following steps:

classification by a computing device of background noises contained in the speech signal according to a predefined set of classes of background noises to identify a class of background noises present in the speech signal; and evaluation by the computing device of the voice quality of the speech signal, according to at least the identified class of background noises present in the speech signal, wherein evaluation comprises:

estimating a total loudness of a noise signal obtained from the speech signal; and calculating a voice quality score as a function of the class of background noise present in the speech signal, and of the total loudness estimated for the noise signal.

2. The method as claimed in claim 1, in which the step of classification of the background noises contained in the speech signal includes:

extraction from the speech signal of a background noise signal, referred to as the noise signal;

calculation of audio parameters of the noise signal; and classification of the background noises contained in the noise signal as a function of the calculated audio parameters, according to said set of classes of background noises.

3. The method as claimed in claim 1, further comprising obtaining the voice quality score according to a mathematical formula of the following general form:

$$\mathrm{MOS_CLi}=C_{i-1}+C_i\times f(N)$$

where:

MOS_CLi is the score calculated for the noise signal;

$f$(N) is a mathematical function of the total loudness, N, estimated for the noise signal;

$C_{i-1}$ and $C_i$ are two coefficients defined for the class of background noise obtained for the noise signal.

4. The method as claimed in claim 3, in which the function $f$(N) is the natural logarithm, Ln(N), of the total loudness N expressed in sones.

5. The method as claimed in claim 1, in which the total loudness of the noise signal is estimated according to an objective model for estimation of the loudness.

6. The method as claimed in claim 2, in which the step of calculation of audio parameters of the noise signal comprises calculation of a first parameter, referred to as a time indicator, relating to a time variation of the noise signal, and of a second parameter, referred to as a frequency indicator, relating to the frequency spectrum of the noise signal.

7. The method as claimed in claim 6, comprising obtaining the time indicator from a calculation of variation of a sound level of the noise signal, and obtaining the frequency indicator (from a calculation of variation of an amplitude of the frequency spectrum of the noise signal.

8. The method as claimed in claim 1, in which, in order to classify the background noises associated with the noise signal, the method comprises the steps of:

comparing the value of the time indicator obtained for the noise signal with a first threshold and determining, depending on the result of this comparison, whether the noise signal is stationary or not;

when the noise signal is identified as non-stationary, comparing the value of the frequency indicator with a second threshold and determining, depending on the result of this comparison, whether the noise signal belongs to a first class or to a second class of background noise; and when the noise signal is identified as stationary, comparing the value of the frequency indicator with a third threshold and determining, depending on the result of this comparison, whether the noise signal belongs to a third class or to a fourth class of background noise.

9. The method as claimed in claim 1, in which the set of classes comprises at least the following classes:

intelligible noise;

environmental noise;

blowing noise;

crackling noise.

10. The method as claimed in claim 2, comprising extracting the noise signal by application to the speech signal of an operation for detection of voice activity, wherein regions of the speech signal not exhibiting voice activity constitute the noise signal.

11. A device for objective evaluation of the voice quality of a speech signal, wherein the device comprises:

means for classification of background noises contained in the speech signal according to a predefined set of classes of background noise to identify a class of background noises present in the speech signal; and means for evaluation of the voice quality of the speech signal as a function of at least the identified class of background noises present in the speech signal, wherein the means for evaluation comprises:

means for estimating a total loudness of a noise signal obtained from the speech signal; and means for calculating a voice quality score as a function of the class of background noise present in the speech signal, and of the total loudness estimated for the noise signal.

12. The device as claimed in claim 11, comprising:

a module configured to extract from the speech signal of a background noise signal, referred to as the noise signal;

a module configured to calculate audio parameters of the noise signal;

a module configured to classify the background noises contained in the noise signal as a function of the calculated audio parameters, according to a predefined set of classes of background noises;

a module configured to evaluate the voice quality of the speech signal as a function of at least the classification obtained relating to the background noises present in the speech signal.

13. A hardware storage device comprising a computer program stored thereon, said program comprising program instructions designed for implementing a method of objectively evaluating voice quality of a speech signal, when said program is loaded and executed in a computing device, wherein the instructions comprise:

instructions that configure the computing device to classify background noises contained in the speech signal according to a predefined set of classes of background noises to identify a class of background noises present in the speech signal; and instructions that configure the computing device to evaluate the voice quality of the speech signal, according to at least the identified class of background noises present in the speech signal, wherein evaluation comprises:

estimating a total loudness of a noise signal obtained from the speech signal; and calculating a voice quality score as a function of the class of background noise present in the speech signal, and of the total loudness estimated for the noise signal.

* * * * *